US007867151B2

(12) United States Patent
Hayes et al.

(10) Patent No.: US 7,867,151 B2
(45) Date of Patent: Jan. 11, 2011

(54) DUAL VARIABLE RESISTANCE CONTROL APPARATUS AND SYSTEM FOR EXERCISE EQUIPMENT

(76) Inventors: James R. Hayes, 5455 Ohio St., Beaumont, TX (US) 77705; Michael Smith, 5455 Ohio St., Beaumont, TX (US) 77705

( * ) Notice: Subject to any disclaimer, the term of this patent is extended or adjusted under 35 U.S.C. 154(b) by 111 days.

(21) Appl. No.: 12/383,068

(22) Filed: Mar. 19, 2009

(65) Prior Publication Data

US 2010/0029448 A1 Feb. 4, 2010

Related U.S. Application Data

(60) Provisional application No. 61/069,909, filed on Mar. 19, 2008.

(51) Int. Cl.
*A63B 21/008* (2006.01)
*A63B 21/00* (2006.01)

(52) U.S. Cl. ..... 482/112; 482/138

(58) Field of Classification Search ..... 482/53, 482/58, 79, 100, 111–113, 135, 137, 138
See application file for complete search history.

(56) References Cited

U.S. PATENT DOCUMENTS 3,822,599 A * 7/1974 Brentham ..... 482/113
4,063,726 A * 12/1977 Wilson ..... 482/5
4,257,593 A * 3/1981 Keiser ..... 482/113
4,353,547 A * 10/1982 Jenkinson ..... 482/113
4,397,462 A * 8/1983 Wilmarth ..... 482/113
4,544,154 A * 10/1985 Ariel ..... 482/5
4,746,115 A * 5/1988 Lahman ..... 482/113
4,750,739 A * 6/1988 Lange ..... 482/104
4,846,466 A * 7/1989 Stima, III ..... 482/112
4,911,436 A * 3/1990 Lighter ..... 482/113
6,413,195 B1 * 7/2002 Barzelay ..... 482/112
6,939,275 B2 * 9/2005 Minogue et al. ..... 482/110
2005/0239615 A1 * 10/2005 Keiser ..... 482/113

* cited by examiner

*Primary Examiner*—Fenn C Mathew
*Assistant Examiner*—Allana Lewin

(57) ABSTRACT

An apparatus and control system for establishing and maintaining a user selected magnitude and direction of pneumatic resistance provided by exercise equipment includes at least one electrically controlled regulator for admitting air to and releasing air from the pneumatic system, transducer for measuring air pressure within the system and providing a corresponding signal, potentiometer for setting and monitoring system pressure in response to signal input from the transducer, air accumulator tank, and pneumatic piston cylinder assembly. The apparatus may also include at least one user controlled electrically switchable four way valve for providing bi-directional resistance. The apparatus is adaptable for providing unilateral or bilateral exercise movements, with or without bi-directional resistance, and can be used to provide range of motion exercise without resistance.

16 Claims, 12 Drawing Sheets

DUAL VARIABLE RESISTANCE CONTROL APPARATUS AND SYSTEM FOR EXERCISE EQUIPMENT

RELATED APPLICATION DATA

This application claims the priority benefits of U.S. Provisional Patent Application Ser. No. 61/069,909, filed Mar. 19, 2008.

FIELD OF THE INVENTION

The present invention generally relates to the field of exercise equipment, and in its preferred embodiments more specifically relates to exercise equipment systems for providing adjustable and controllable pneumatic resistance to movement in one or both directions, independent of the speed of movement against the resistance, and to a pneumatic resistance control system for such equipment.

BACKGROUND

As weight or resistance based strength training has become increasingly popular and more prevalent fitness activity, equipment used in strength training has progressed from simple free weights to stacked weight machines, spring resistance machines, and hydraulic or pneumatic resistance machines. In many strength training regimens hydraulic and/or pneumatic resistance equipment is preferred over free weights and other direct weight systems for a number of reasons, including safety.

Because hydraulic and pneumatic resistance training equipment not only reduces the risk of physical injury but also tends to smooth movements and bodily impact to the degree that such equipment is much more suitable to achieving a "low impact" exercise regime. Pneumatic equipment is more effective in providing a low impact workout than hydraulic, because of the inherent cushioning effect provided by the compressible gas as opposed to a non-compressible liquid such as hydraulic fluid. In addition, hydraulic and/or pneumatic equipment can be used to impose resistance to movement in both "push" and "pull" directions, so as to work two muscle groups with a single piece of equipment. It is also known that the hydraulic and/or pneumatic equipment can be adjusted to provide a different level of resistance for the push stroke and the pull stroke.

However, all hydraulic equipment and pneumatic equipment designs known in the prior art utilize relatively simple valve assemblies to increase and decrease resistance by respectively decreasing or increasing the area of the fluid flow passageway through the valve or valves. While this approach does allow some degree of adjustment in resistance, in reality the degree of control is limited by the fact that the resistance to movement in prior art systems is directly proportional to the speed of movement. The faster a user pushes or pulls against the resistance, the higher the resistance provided by the machine becomes, and conversely the slower the user pushes or pulls, the lower the resistance becomes. This disadvantage is most significant for users whose training objectives are best achieved by rapid movement or a combination of relatively rapid movements and relatively slow movements against a consistent resistance. For example, swimmers derive the most benefit from a combination of movements against a relatively low, but consistent resistance, whereas body builders benefit more from slower repetitions against a high, consistent resistance. Neither the hydraulic nor the pneumatic equipment known in the prior art is capable of providing consistent resistance independently of speed of movement, despite the clear need for such a system.

SUMMARY OF THE INVENTION

The present invention is a significant advancement in the art, in that it provides a controllable pneumatic resistance system for exercise equipment that achieves all the advantages of prior art pneumatic (as well as hydraulic) equipment without the disadvantages associated with it. The system of the present invention allows independent adjustment of push resistance and pull resistance, and maintains the selected resistance(s) regardless of the speed of movement. The system of the invention also allows the user to choose between bilateral operation, in which muscles on one side of the body can be worked independently from muscles on the other side, and unilateral exercise, in which muscles on both sides of the body are worked together. Because the system of the invention allows bilateral control, the two sides of the body may be worked together, but with different resistance levels. The system will also allow a user to perform a push stroke with muscles on one side of the body while simultaneously performing a pull stroke with muscles on the other side of the body. For example, when the system used with dual function equipment for military press and lat pull-down exercises, a user can exercise with a swimming arm motion. The degree of adjustability and the ability to control functions "on the fly", without interrupting the exercise, greatly increases the range of choices available in a training regimen.

The system of the invention also offers unprecedented advantages and benefits for physical rehabilitation therapy. In such therapy it is often desirable for a patient's arms, for example, to be pulled in an extension stroke and pushed in the return stroke, a function which conventional strength training exercise equipment is not able to provide. The system of the invention can, without any modification other than changes in control settings, provide an upward force for, e.g., lifting a patient's arms together, or a single arm independently of the other, from a rest position to an extended position, and/or to provide a downward force to push the patient's arms or arm back to the rest position. In such operations the equipment, rather than the user, provides the pulling and pushing force, and the patient's arms or arm act in resistance to that force.

In the preferred embodiments of the system of the invention, compressed air is supplied to air cylinders and accumulator tanks through an electronic regulator. The electronic regulator controls pressure and maintains the selected pressure setting by adding or relieving air during each movement or stroke made by the user. The pressure setting is selected and controlled by a user through adjustment of the electrical voltage available to the electronic regulator by means of a potentiometer button, switch, knob, or the like. The air pressure setting from the electronic regulator and the pressure reading is fed via a pressure transducer to a digital readout that can be monitored by the user. This first portion of the system, or first subsystem, controls the equipment reaction to user movement against the resistance in one direction. A second, duplicate subsystem controls the equipment in reaction to movement in the opposite direction. Transfers between the subsystems are controlled by an electrical pilot 4-way valve. The 4-way valve is controlled by the user by pushing a button mounted in a convenient easily reachable location, such as, without limitation, on the handles of the exercise machine.

As a non-limiting example, with the system of the invention, a piece of equipment configured as a single purpose military press exercise machine can also function as a military press machine and/or as a lat pull down machine. Each exercise can have a different pressure/resistance setting and also allow for unilateral or bilateral training. The system of the invention will allow the machine to function as a dual purpose machine or continue to function as single purpose machine. In single purpose mode the machine will function as either a military press or as a lat pull down machine.

The structure and functions of the system of the invention will be described in detail below, with reference to the accompanying drawing figures.

DESCRIPTION OF THE INVENTION

Figure 1:
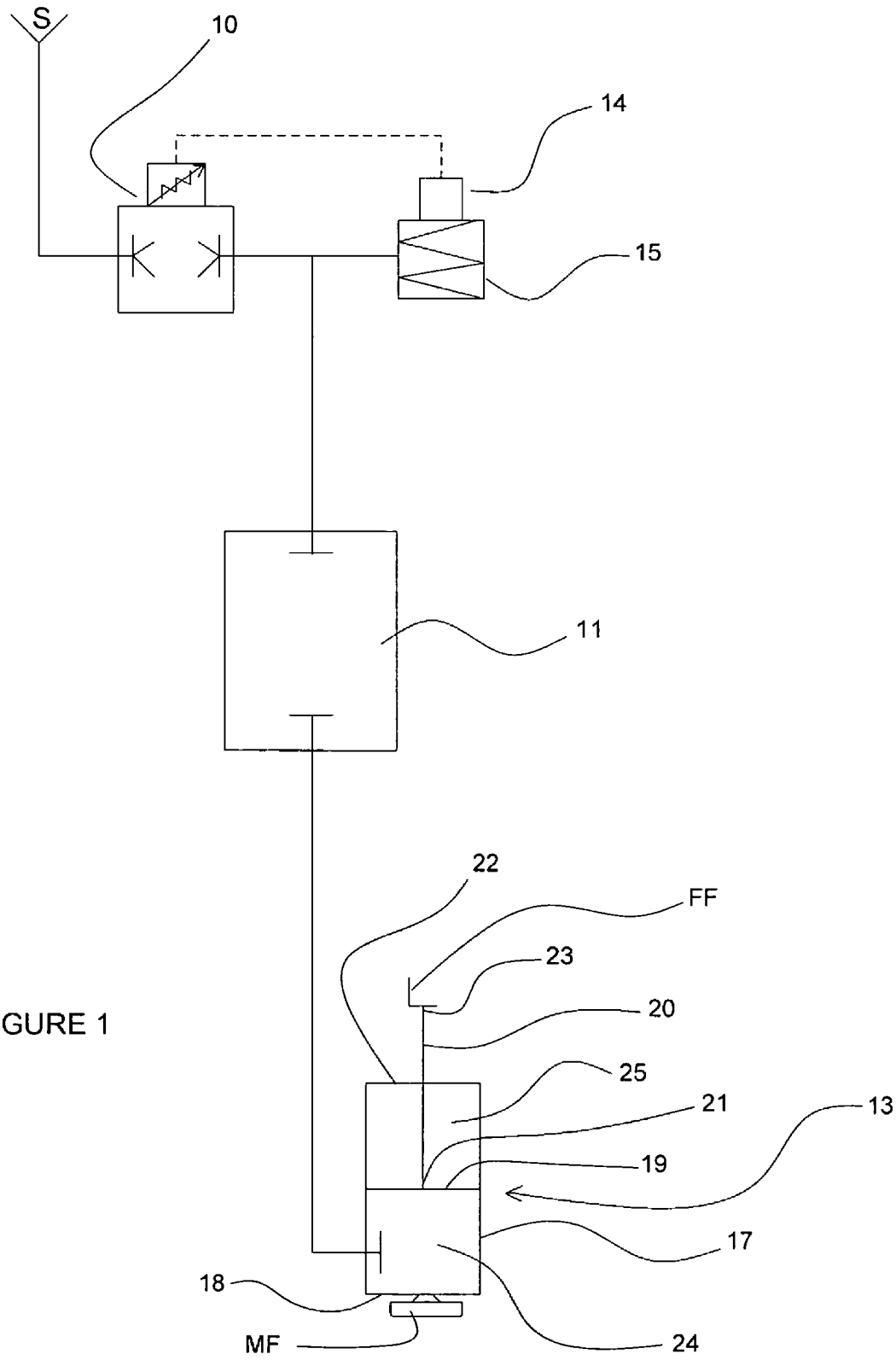
FIG. 1 is a schematic illustration of a unilateral single action military press embodiment of the system of the invention.

In its preferred embodiment, the system of the invention is a pneumatic system, utilizing a compressible gas as the working gas, and is configured as what is referred to as a dual-duplex system. Although the use of any compressible gas is feasible, compressed air will be most commonly used, and references to air herein shall not be taken as limiting. The apparatus of the system of the invention related to air flow and control through the apparatus includes, as primary components, electronic regulators 10, accumulator tanks 11, four-way control valves 12, pneumatic piston-cylinder assemblies 13, potentiometers 14, and transducers 15, with associated connecting tubing and with electrical wiring to provide power for operation and control. The preferred embodiment of the system further includes digital displays 16 to provide information to the user for selecting and monitoring the pressure/resistance at which the user desires the equipment to operate.

Figure 7:
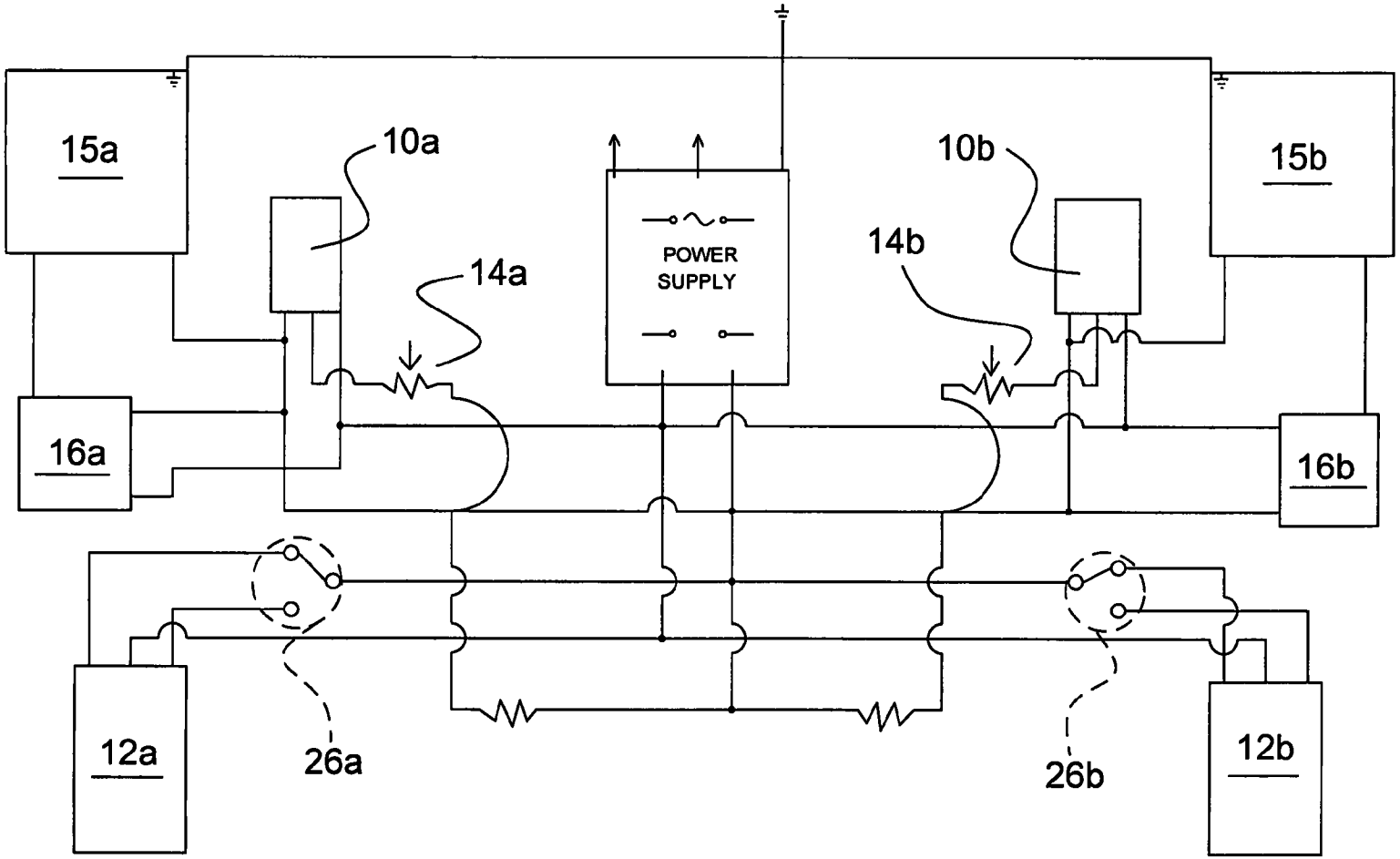
FIG. 7 is a schematic electrical diagram of the preferred electrical system for the system of the invention.
Figure 8:
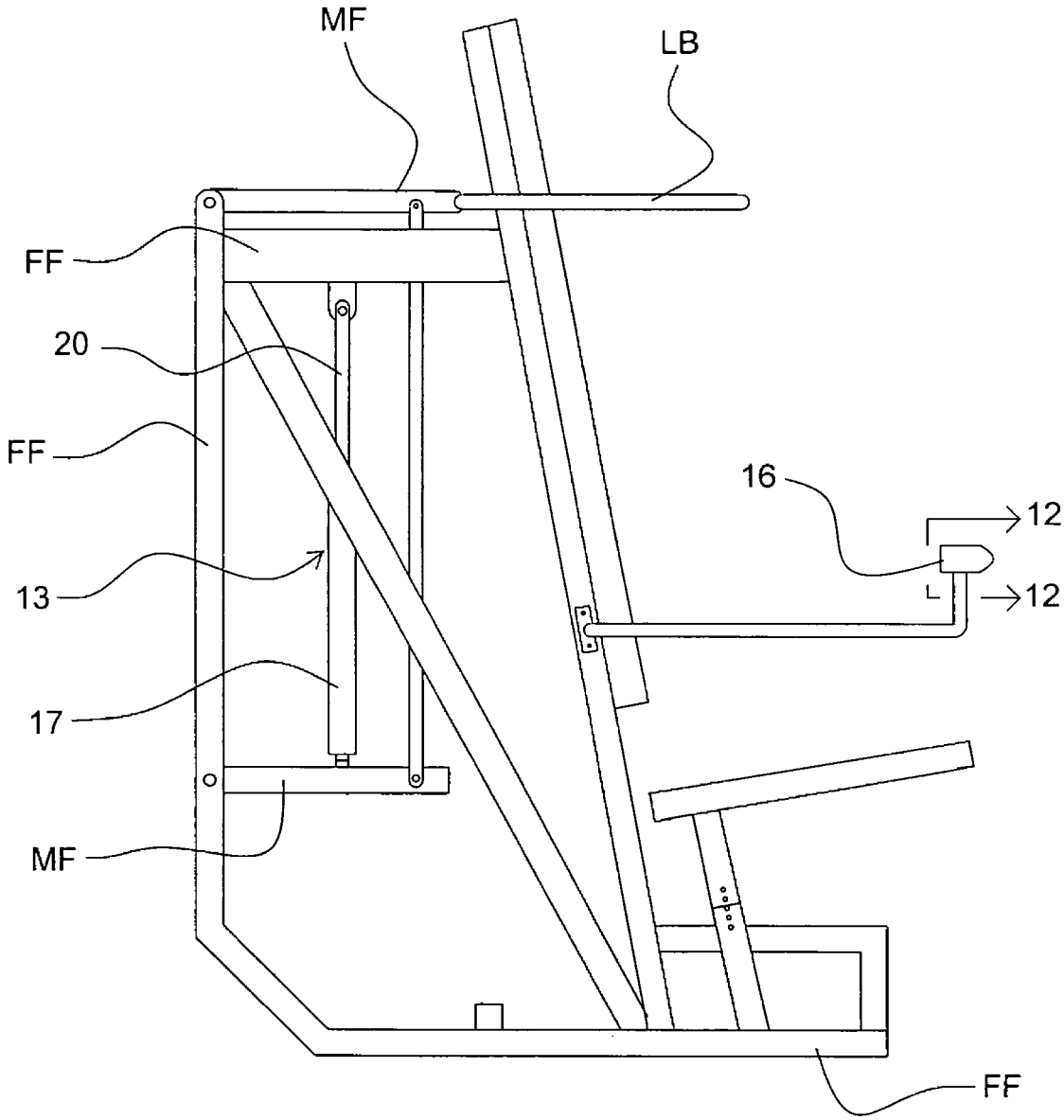
FIG. 8 is a simplified side elevation view of a piece of exercise equipment, illustrating a general positioning of components of the system of the invention.
Figure 9:
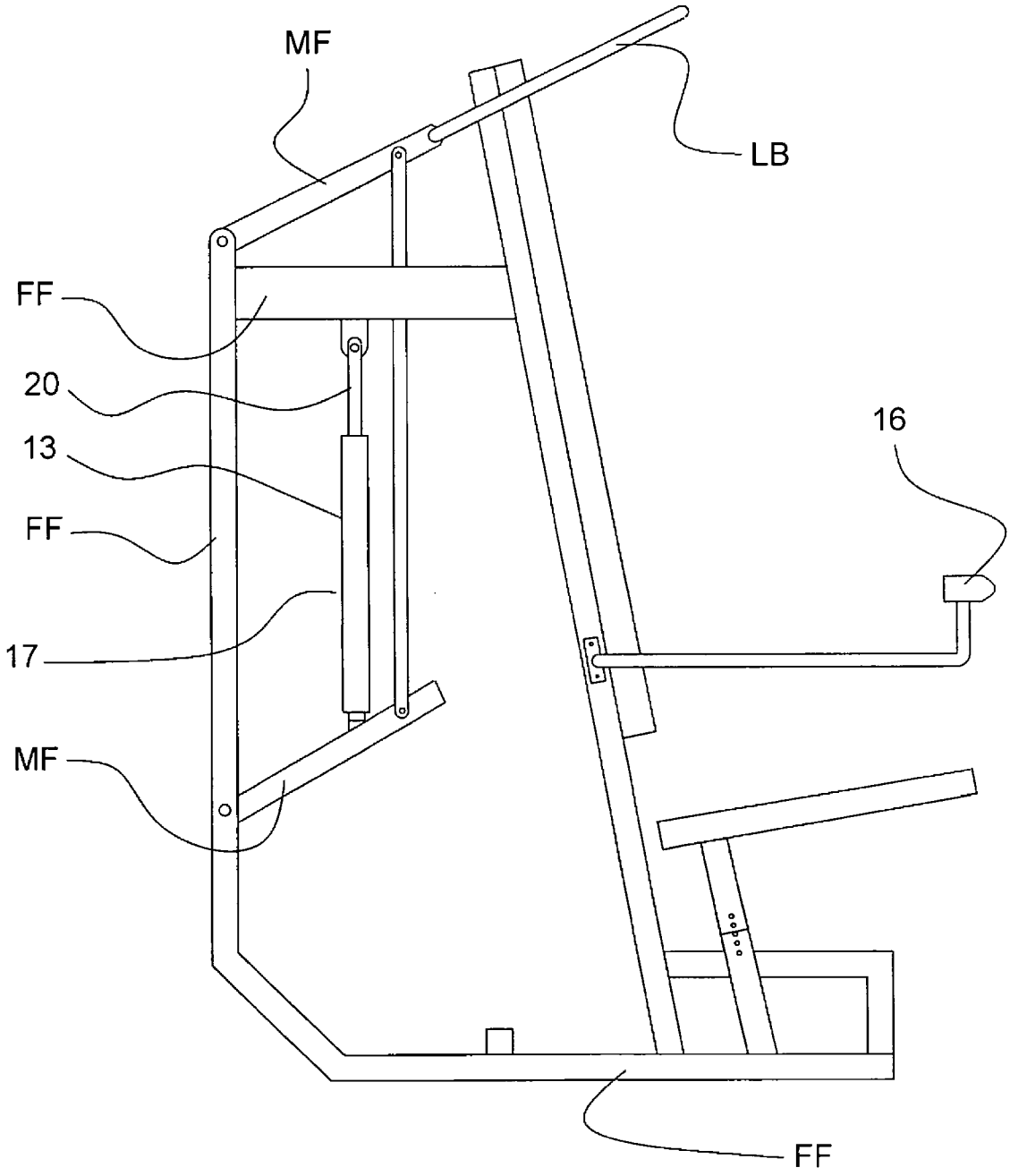
FIG. 9 is a simplified side elevation view of the exercise equipment shown in FIG. 8, with the lifting bar and moveable frame in a raised position, and with a structural brace removed for clarity.
Figure 10:
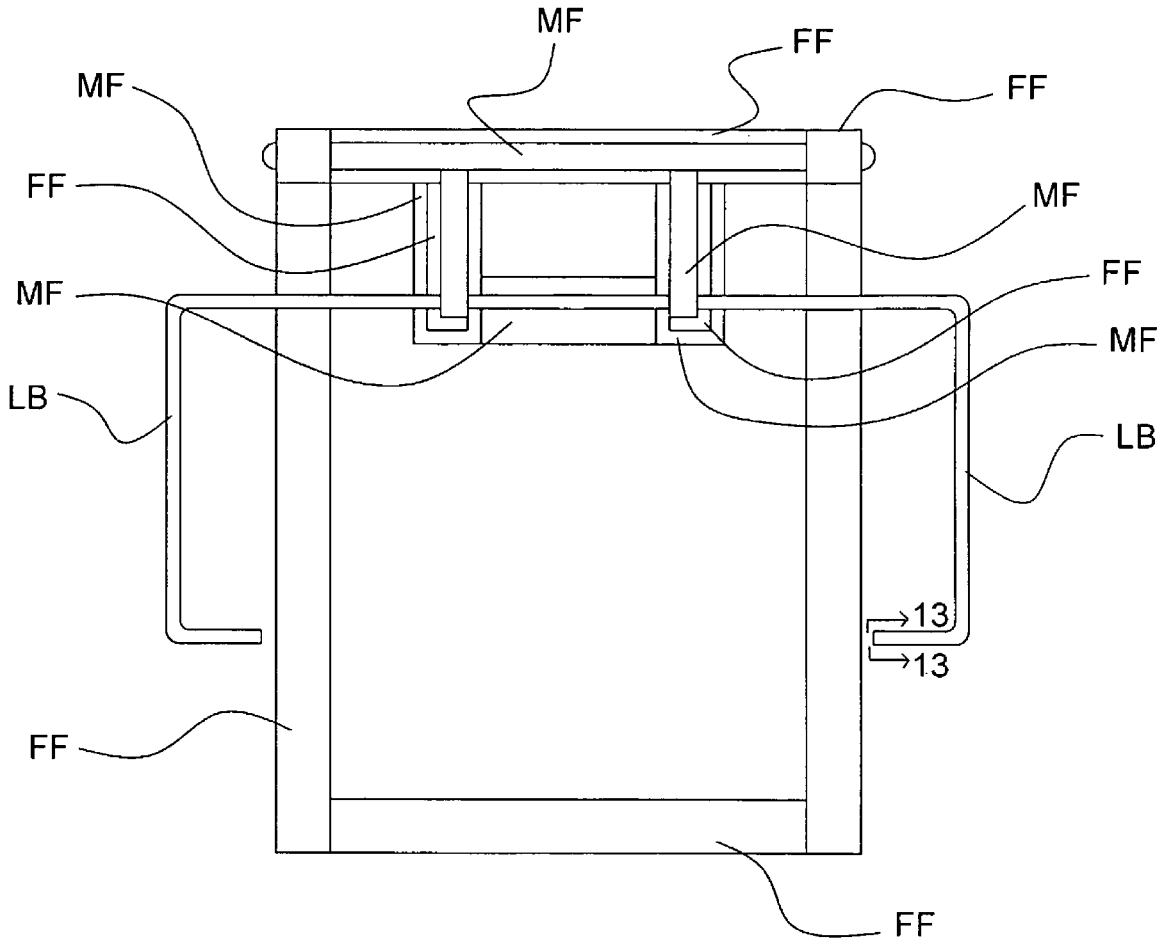
FIG. 10 is a simplified top plan view of a piece of exercise equipment constructed and configured for unilateral operation, showing fixed frame and moveable frame components.
Figure 11:
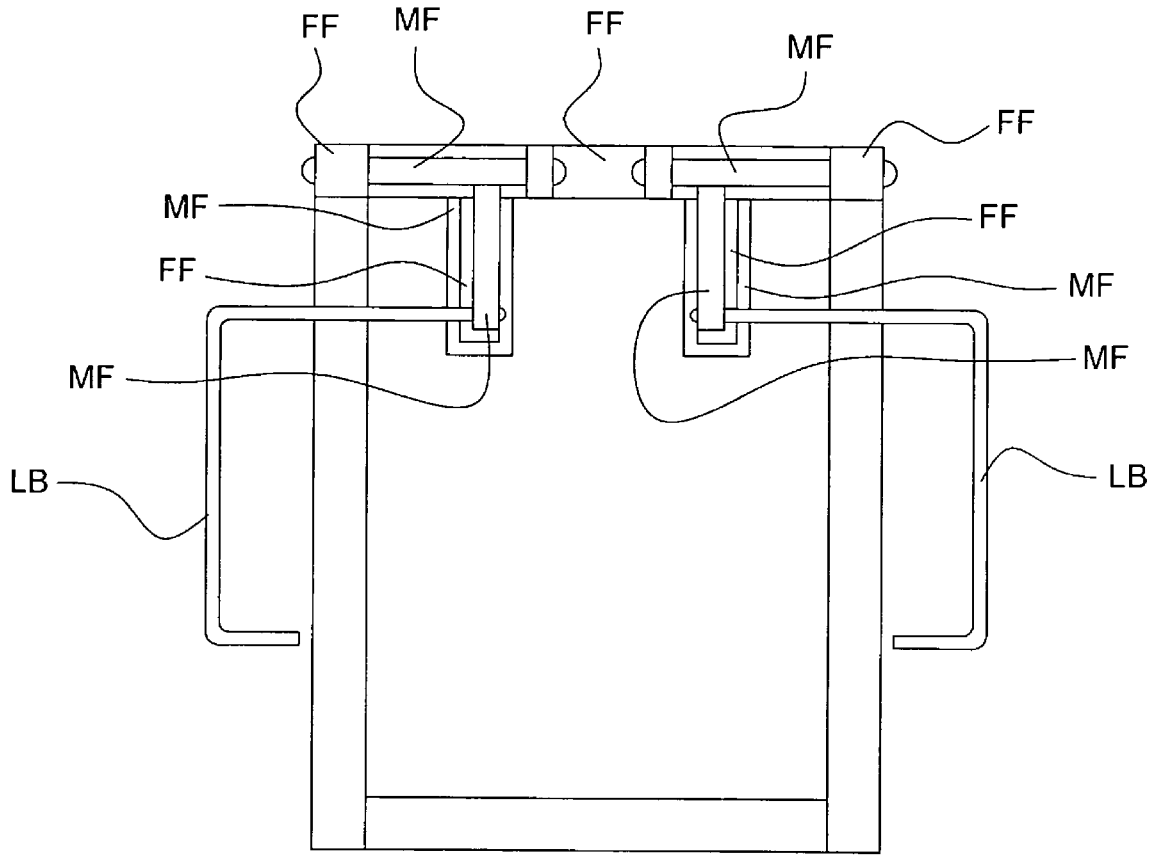
FIG. 11 is a simplified top plan view of a piece of exercise equipment as in FIG. 10, but constructed and configured for bilateral operation.
Figure 12:
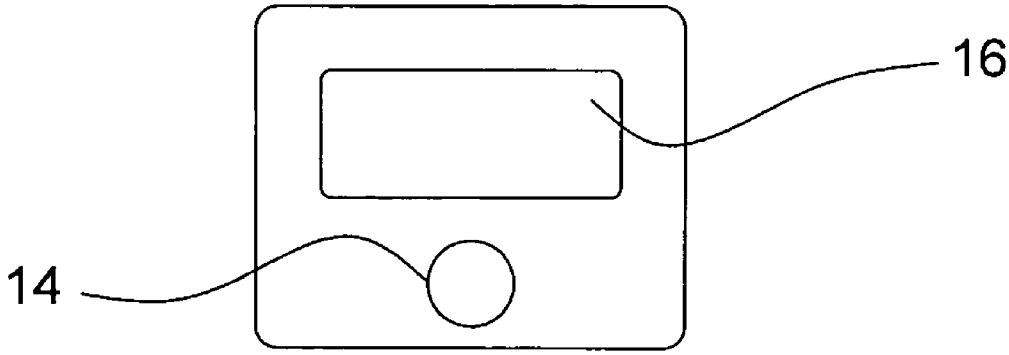
FIG. 12 is a front elevation view of a combined digital display component and a potentiometer component of the system of the invention, along line 12-12 of FIG. 8.
Figure 13:
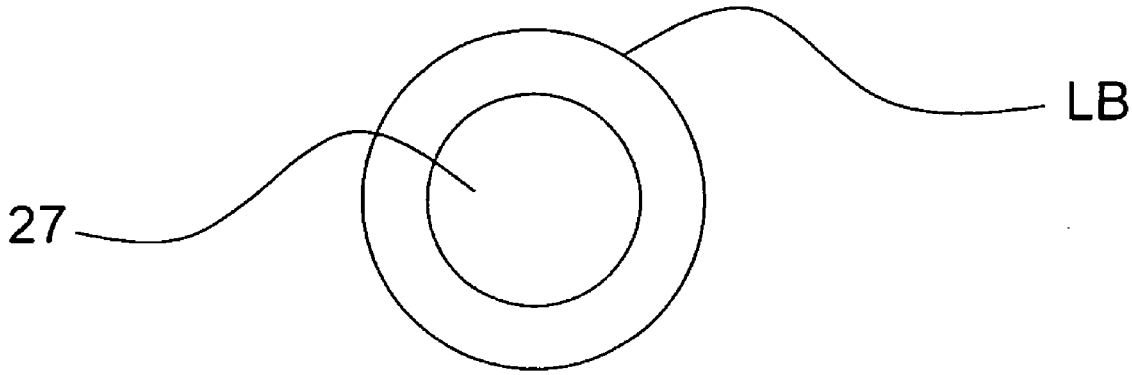
FIG. 13 is a front elevation view of a gripping end of a lifting bar component, showing a push button for a switch component of the system of the invention.

The electrical system for the preferred embodiments is illustrated and components thereof are identified in FIG. 7. Individual electrical components utilized within the unique system of the invention, including potentiometers 14, transducers 15, and the electrical/electronic components of regulators 10 and digital displays 16, are not, in and of themselves, unique, but are known and understood in the art. The use of known components will facilitate understanding, construction, and use of equipment utilizing the system of the invention to achieve the unique benefits it provides. Accordingly, the following description is focused upon the interaction of both mechanical/pneumatic components and electrical components rather than upon details of component construction and operation. Also in the following discussion, the term "resistance" is, unless otherwise indicated, used to refer to physical or mechanical resistance felt by a user of the exercise equipment in which the system of the invention is incorporated, rather than to refer to electrical resistance.

Air is supplied to the system from a compressed air source S through the electronic regulators 10. Each regulator 10 will selectively operate to allow air to flow from the source S through the regulator into the system, to release air from the system, or to prevent air flow to or from the system, each in response to signals generated by the associated transducer and transmitted through the associated potentiometer. The compressed air source is not specifically a part of the system apparatus, and it is to be understood that any suitable source may be used. In the preferred embodiment compressed air is supplied from the source at a pressure of about 100 psi (pounds per square inch), with a maximum flow rate of about 3 cfm (cubic feet per minute). Although these values are preferred, it is to be understood that the available pressure and available flow rate may vary through a range of values, so long as the capacity of the electronic regulators 10 is consistent with the selected pressure and available flow rate values. The internal system pressure downstream of the electronic regulators is controlled by the operation of those regulators, and is not directly related to the air pressure or available flow rate from the compressed air source.

The system of the invention is, as noted above, preferably configured as a duplex system that is divided into two essentially identical branches, each with identical components. The reference numbers used to identify components duplicated in the two branches are modified by the addition of the letter "a" to branch 1 components, and the letter "b" to branch 2 components when a distinction is needed for clarity of description. When a component is duplicated within a branch, as is the case with the accumulator tanks and the pneumatic cylinders, the reference numbers for those components are further modified by the addition of "−1" or "−2" to the lower case letter modifiers when a distinction between the duplicated components within a branch is needed. For example, two accumulator tanks within a branch 1 may be identified as 11*a*-1 and 11*a*-2, and the accumulator tanks within a branch 2 may be identified as 11*b*-1 and 11*b*-2. The reference numbers are used without modifiers in this description when the reference is to a component generally and a further distinction is not material to the description.

Although in the preferred embodiment the system includes two branches, relating to the two sides of a user's body, and is designed to operate in a bilateral dual action mode, air movement through the system, and the control thereof, will be described first in terms of a simplified system, with one branch, and a single action mode, in which both arms are used together. For purposes of the present description, exercise in which a unitary lifting bar is moved by a user with both arms in the same direction is referred to as "unilateral", and exercise in which a the two sides of a bifurcated lifting bar can be moved independently is referred to as "bilateral". As illustrated in FIG. 1, such a simplified system includes one electronic regulator 10, one accumulator tank 11, and one pneumatic piston-cylinder 13. In this simplified system control valve 12, which is used to switch between action modes, is not required. To provide control over the operation of regulator 10, a transducer 15 is pneumatically connected to the regulator and electrically connected to a potentiometer 14, which is electrically connected to the regulator. The potentiometer is adjustable by the user in a range of resistance settings, and the resistance setting determines the internal system starting pressure. Transducer 15 reads the system pressure, and in combination with potentiometer 14 and regulator 10, provides user control over system pressure. In response to pressure readings from the transducer and the settings of the potentiometer, the regulator will admit air to or release air from the system to maintain the selected resistance pressure.

An air supply line is connected from source S to regulator 10. An air line from regulator 10 is routed to a T connection, and from the T connection to transducer 15, and accumulator 11. An air line connection is made between accumulator 11 and piston-cylinder 13, and in this embodiment air moves directly between the accumulator and the piston-cylinder without passing through a control valve. The piston-cylinder assembly 13 includes a generally conventional pneumatic cylinder 17, with a first end 18, a piston 19 disposed in the interior of the cylinder in moveable, sealed relation to the cylinder, a piston rod 20 connected at its first end 21 to the piston and extending outwardly from the cylinder through and in sealed relation with an aperture at the second end 22 of the cylinder, with the second end 23 of the piston rod disposed outside the cylinder. Piston 19 thus divides the interior of the cylinder into a first space 24, between the first end 18 and the piston, and a second space 25, between the piston and the second end of the cylinder. The air line between the accumulator and the cylinder is connected to the first space of the cylinder to form an air passageway between them.

The system components described above are connected to the structural framework of an exercise machine. Continuing the example of a military press machine, configured with a single lift bar structure LB that is pivotally connected at one end to the upper portion of the fixed frame FF of the machine and unconfined at the other end, to which a hand grip is connected, the first end 18 of cylinder 17 is connected to a moveable frame MF that is pivotally connected to the fixed frame and to the lifting bar such that the lifting bar and the moveable frame remain parallel and move together. The regulator, accumulator tank, potentiometer, and control valve are not moving components and may be connected to the fixed frame at any desired location. The first 18 end of cylinder 17 is connected to the moveable frame of the exercise machine, so that the cylinder raises and lowers with raising and lowering of the lifting arm. The second end 23 of piston rod 20 is connected to the fixed frame of the machine, so that piston remains fixed in place and does not move.

With this mechanical arrangement, when the lifting bar is raised by a user to perform the extension portion of a military press, cylinder 17 is also raised, moving the cylinder relative to the piston. That cylinder movement decreases the volume of space 24 within cylinder 17, which results in an increase in the pressure of the air in space 24 as it is compressed. The pressure increase due to compression occurs not only in space 24, but also in the portion of the system between the regulator and the cylinder, including the accumulator tank. Because space 24 within the cylinder is connected to the other portions of the air system, the total volume of the system is greater than the volume of space 24 alone at any time. An incremental movement of the piston in compression results in a smaller proportional decrease in the volume of the entire system than the proportional decrease in volume of space 24 alone. As a result, the proportional change in system pressure is also lower, and there is less change in resistance felt by a user at the initiation of the extension stroke of the exercise than is created by prior art pneumatic exercise machines. Simultaneously, and much more significantly, as the piston moves in compression during an extension stroke, the pressure change is immediately communicated to the pressure reading and control components, which, in response to the imbalance between the pressure reading and the pressure setting, result in the release of air from the system by regulator 10 to maintain the preselected system pressure. Because air is released as the total system volume is reduced by the movement of piston 18, the pressure within the system changes only minimally and there is no perceived change in resistance through the military press extension movement.

When the user completes the extension stroke and ceases pushing upward on the lifting bar, the cylinder begins to move downward, in response to gravity and to the slight pressure difference between space 24 and space 25, beginning the return stroke. Downward movement of the piston begins to decrease the actual system pressure read by the transducer, which pressure will quickly drop below the selected system pressure and result in a signal from the potentiometer which activates the regulator to open and admit compressed air into the system until the selected pressure is reached and the regulator is signaled to close. The entry of air through the regulator and the resulting increase in system pressure adds to the downward force on the lifting bar until the regulator is closed and the entry of air is stopped. That downward force continues until the cylinder reaches the end of its downward travel and the exercise machine is ready for another upward stroke. In the system of the invention, accumulator 11 functions as a damper, to moderate the effects of air flows and pressure changes and smooth the changes in system "feel" encountered by a user. It will be understood from the foregoing description that the system functions to maintain the resistance felt by a user of the exercise equipment independently of the speed with which the user moves the lifting bar in the extension stroke or allows the lifting bar to drop in the return stroke. Accordingly, exercise equipment provided with the system of the invention provides to a user an exercise experience that is a much close replication of free weight or stacked weight exercise than is available from prior art pneumatic or hydraulic exercise equipment and systems.

Although an exercise machine with the simplified embodiment of the system of the invention described immediately above is limited to providing unilateral, single action exercise resistance, it will be understood by those of skill in the art that the system of the invention, even in a relatively simple mechanical system, overcomes one of the most significant disadvantages associated with prior art pneumatic and hydraulic exercise equipment. Regardless of the mechanical simplicity or complexity of the equipment with which it is used, the system of the invention provides effectively constant, consistent resistance throughout a user's movement, rather than the variable resistance that is an inherent disadvantage of prior art equipment.

Figure 2:
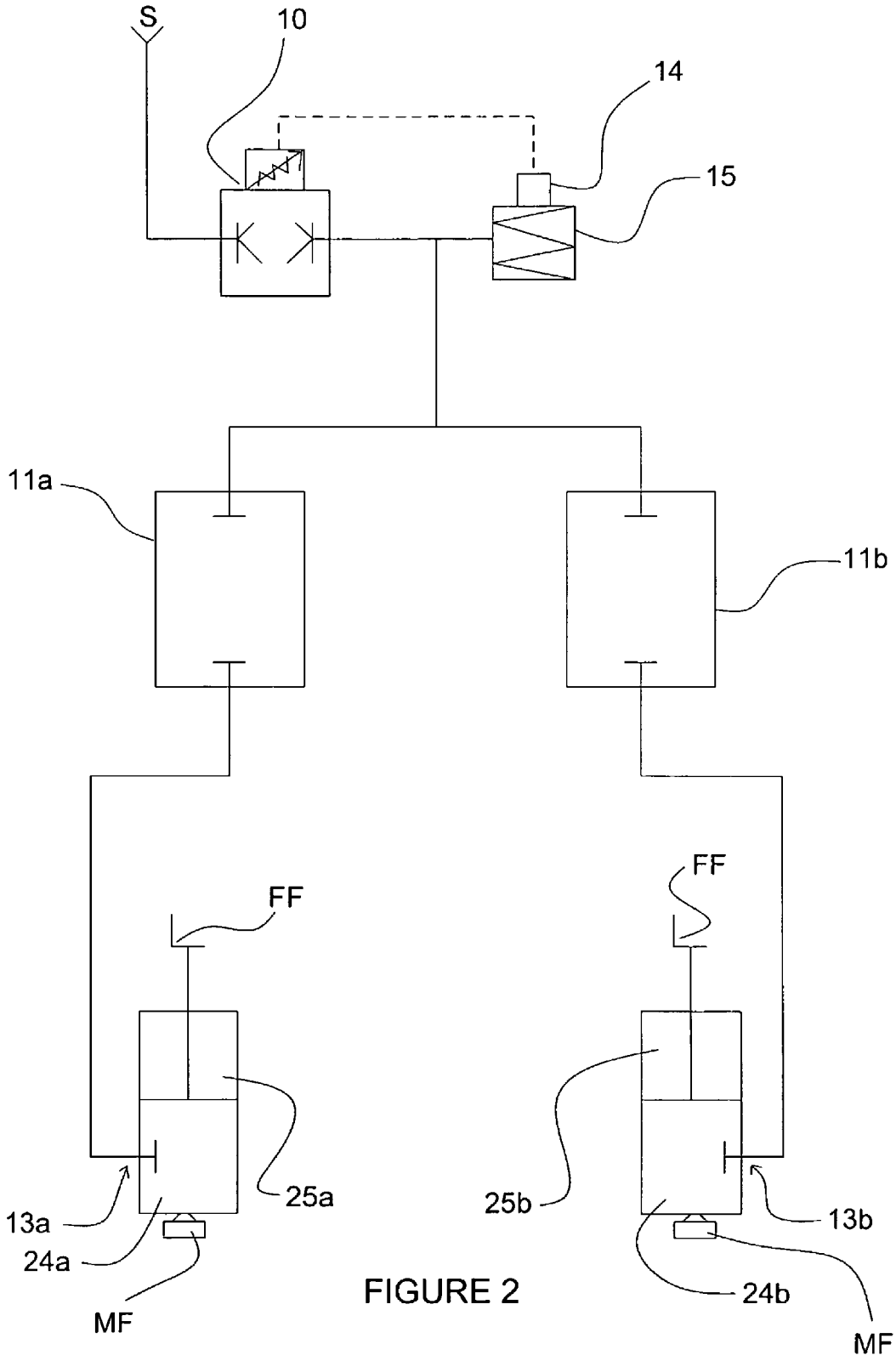
FIG. 2 is a schematic illustration of a bilateral single action military press embodiment of the system.

The unilateral military press exercise system described above may be easily expanded to provide bilateral (each arm independently) exercise resistance by duplicating the control system and mechanical structure in a mirrored structure on the opposite side of the machine, illustrated in FIG. 2, creating two branches in which the single cylinder 17 becomes two cylinders 17*a* and 17*b*, and the single accumulator tank 11 becomes two accumulators 11*a* and 11*b*. The single lifting arm of the previously described embodiment is divided, as is the moveable frame of the equipment, so that the mechanical linkages are duplicated. Each cylinder is connected to a respective side of the equipment, so that each is operated by the respective lifting arm. The two piston-cylinders and the two accumulators are both in mutual air-flow communication with a single regulator 10, potentiometer 14 and transducer 15, so that the system pressure in both branches a and b is the same. The structural elements of the exercise machine which support and interact with the control system components, as described above, are also duplicated in a mirrored version on the opposite side of the machine, providing two independently moveable lifting arms. Operation of this bilateral, single action mode system is as described above, since the mirrored sets of components operate the same way at the same time.

Figure 3:
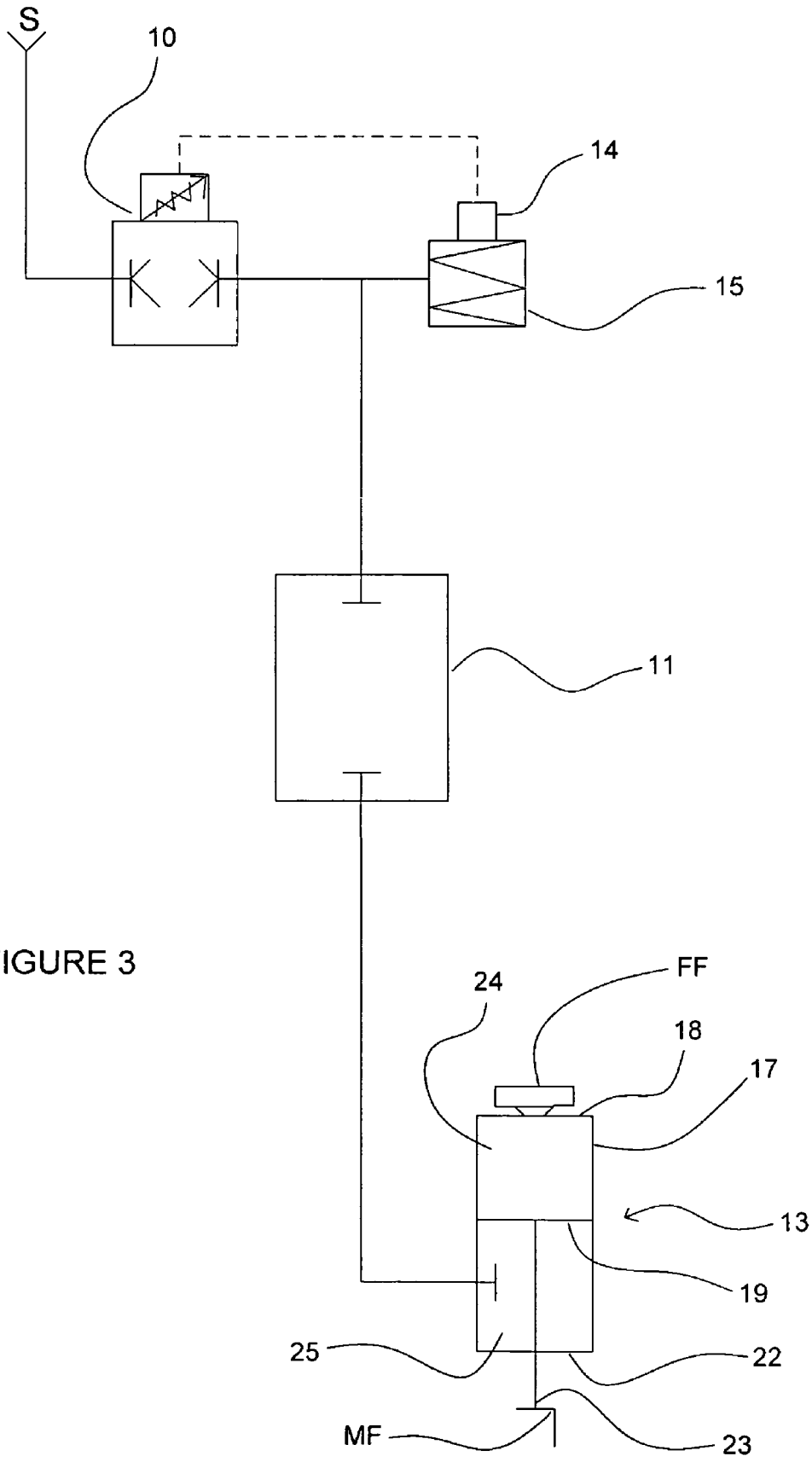
FIG. 3 is a schematic illustration of a unilateral single action lat pull-down embodiment of the system.

In another embodiment, schematically illustrated in FIG. 3, the system may be configured and arranged to provide a unilateral lat pull-down machine. In a lat pull-down machine the user exerts force with his or her arms to pull down against resistance, rather than pushing up as with a military press machine. In the lat pull-down configuration the components of the control system are the same as identified above, with the primary difference being in the air flow connection between accumulator 11 and piston-cylinder 13, and in the mechanical connection between the cylinder and the framework of the machine. In this embodiment the piston-cylinder 13 is inverted in comparison to the military press embodiment, and the first end of cylinder 17 is connected to the fixed frame of the machine rather than to the moveable frame. The second end of piston rod 20 is connected to the pivoting moveable frame of the machine rather than to the fixed frame, so that movement of the lifting bar causes movement of the piston rod and piston relative to the fixed cylinder rather than movement of the cylinder relative to the fixed piston rod and piston as in the military press embodiment. As in all embodiments of the system, piston 19 divides the interior of cylinder 17 into two spaces, space 24 between the first end of the cylinder and the piston, and space 25 between the piston and the second end of the cylinder. In this embodiment the air line connection between accumulator 11 and cylinder 17 is made to space 25 of the piston, rather than to space 24 as in the military press embodiment.

When the equipment and control system are activated, compressed air is introduced to space 25, increasing pressure in that space and imposing an upward force against the piston. The piston will move toward the fixed first end of cylinder 17, pulling the moveable frame of the machine to which the second end of the piston rod is connected in the same upward direction. The lifting bar connected to the moveable frame is also moved in an upward direction to the upward end of its range of motion, setting the machine for the first pull-down stroke. As the lifting bar is pulled down by a user from the upward start position, the pressure in space 25 is increased, causing air movement and control system response in the same manner as described above for the single action military press configuration. When the lifting bar is pulled to the bottom end of the pull-down stroke and the user begins movement in the opposite direction to return to the start position, the pressure differential between the two spaces in cylinder 17 continues to impose an upward pressure, replicating the exercise experience achieved with a weight based lat pull-down machine.

Figure 4:
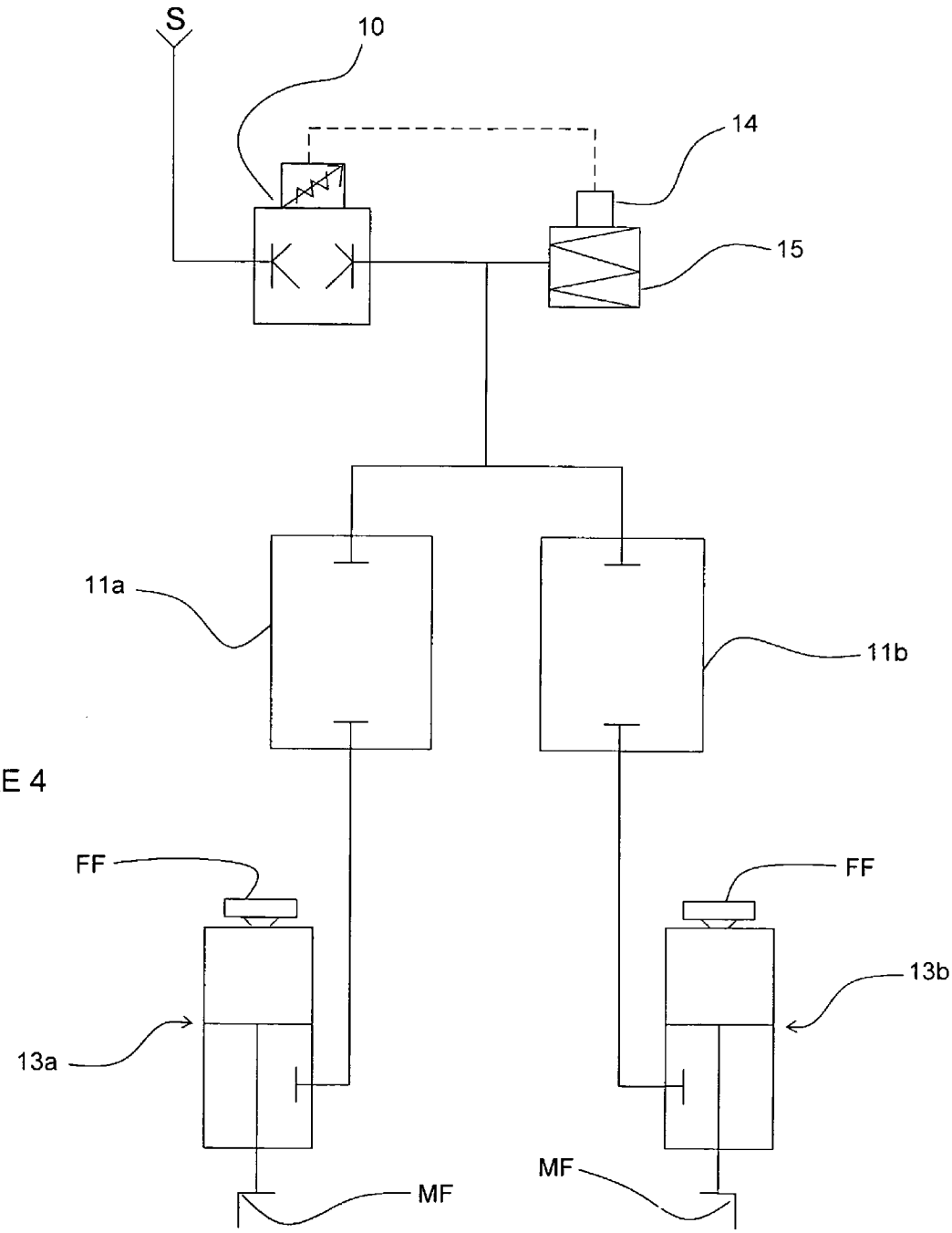
FIG. 4 is a schematic illustration of a bilateral single action lat pull-down embodiment of the system.

In the same manner as described above for a military press action mode, the unilateral lat pull-down machine can be easily expanded to a bilateral machine, schematically illustrated in FIG. 4, by duplicating the components in mirrored relation on the other side of the machine. In the bilateral configuration, there are two piston-cylinders 13 identified as 13*a* and 13*b*, two accumulator tanks 11*a* and 11*b*, and two lifting bars and moveable frame components. System pressure is controlled and maintained by a single potentiometer 14 and transducer 15, and single regulator 10, as in the bilateral military press mode.

The military press structure and system operation can be combined with the lat pull-down structure and system operation to provide dual action embodiments that allow a user to accomplish both exercises on the same machine, either independently as described above for the single action modes, or at the same time. In these embodiments either one or two control valves 12 are included in the system to enable a user to switch between action modes. The simplest dual action system configuration is for a unilateral dual action embodiment. The control system for this embodiment includes two regulators 10-1 and 10-2, two accumulator tanks 11-1 and 11-2, two potentiometers 14-1 and 14-2, two transducers 15-1 and 15-2, one control valve 12, and two piston-cylinders 13-1 and 13-2. In this description of a dual mode, military press and lat pull-down system, the reference number modifier -1 refers to components associated with and controlling the military press portion of the system, and reference number modifier -2 refers to components associated with and controlling the lat pull-down portion.

Figure 5:
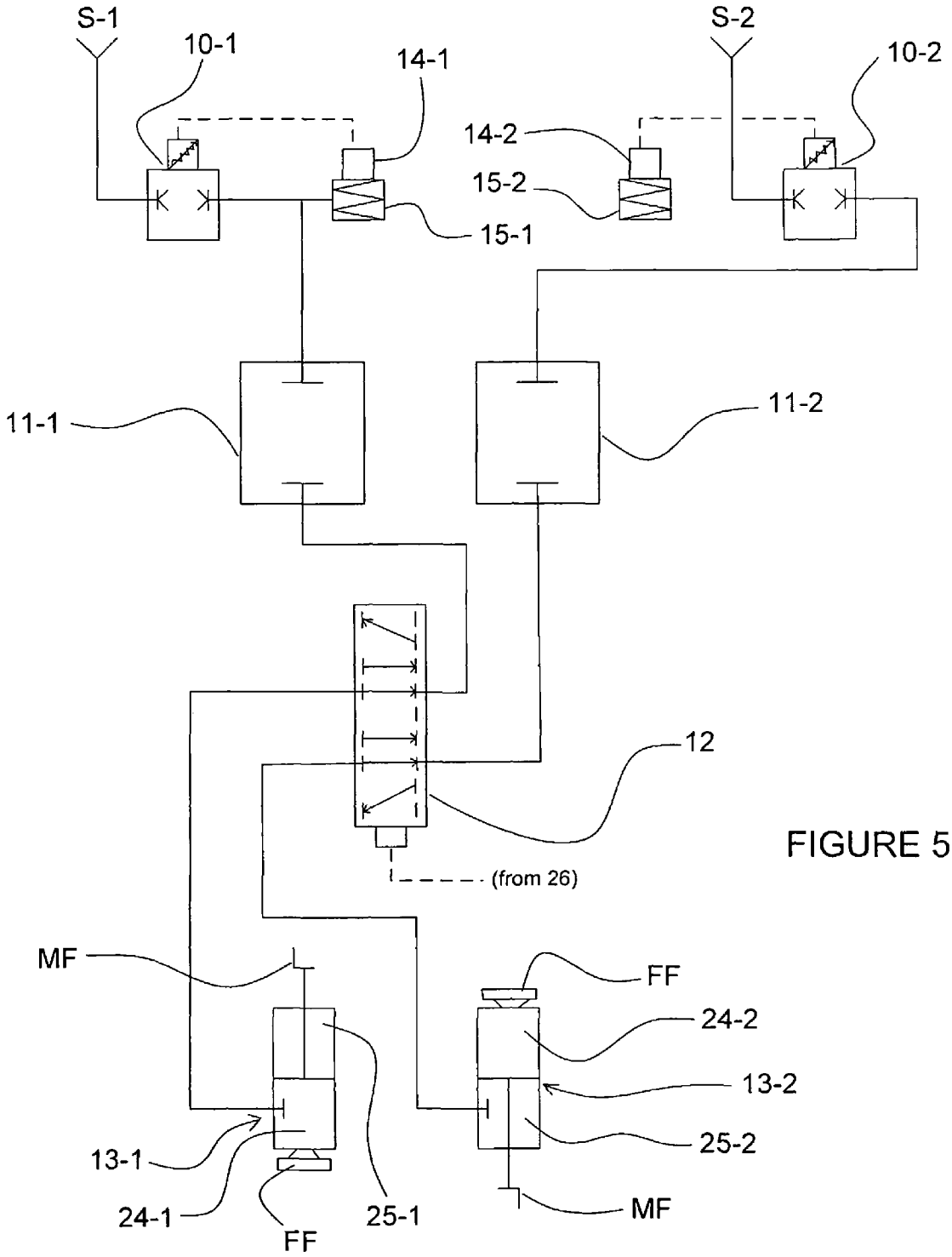
FIG. 5 is a schematic illustration of a unilateral dual action military press and lat pull-down embodiment of the system.

In this embodiment, schematically illustrated in FIG. 5, air is provided for the military press mode from a first source of compressed air S-1, through regulator 10-1, which is controlled by potentiometer 14-1 and transducer 15-1, through accumulator 11-1, and through control valve 12 to space 24 of cylinder 17-1. Air for the lat pull-down mode is provided from a second source of compressed air S-2, through regulator 10-2, which is controlled by potentiometer 14-2 and transducer 15-2, through accumulator 11-2, and through control valve 12 to space 25 of cylinder 17-2. Control valve 12 is a four way valve, preferably electrically activated. Actuation of valve 12 to change between modes is preferably accomplished using an electrical switch 26, preferably actuated by a push button 27 disposed in a location convenient for user operation. The preferred location is at the outer end(s) of the lifting bar(s) or associated handle(s), so it can be easily operated by presses of a user's thumb to change between modes.

To prepare the unilateral dual action exercise machine embodiment for combined action, a user first selects the military press pressure/resistance value and sets potentiometer 14-1 for that resistance. The user then selects the lat pull-down pressure/resistance value and sets potentiometer 14-2 for that resistance. It is to be understood that the resistance values for each exercise mode can be selected and set independently of each other and need not be the same. With control valve 12 set for military press action and regulator 10-1 connected to air source S-1, space 24 of cylinder 17-1 is pressurized to the selected military press value through valve 12, preparing the machine for a military press upward stroke or extension. With valve 12 configured for military press mode, the flow passageway through valve 12 to cylinder 17-2 is blocked and piston-cylinder 13-2 is pneumatically isolated from the remainder of the system. During the upward military press stroke the system of the invention functions exactly as described above to maintain the selected pressure/resistance imposed by piston-cylinder 13-1 to resist upward movement of the lifting bar. When the upward stroke is completed, the user actuates switch 26 to change control valve 12 from the military press setting to the lat pull-down setting. When valve 12 is activated, the configuration of valve 12 changes to open the previously closed passageway through the valve, and to close the previously open passageway. With regulator 10-2 connected to air source S-2, air from that source is routed through accumulator 11-2, through control valve 12 and to space 25 of cylinder 17-2, preparing the machine for a lat pull-down downward stroke. As described above for single action lat pull-down exercise, the pressure in space 25 imposes an upward pressure acting on the lifting bar to resist downward movement of the lifting bar, providing the resistance for the lat pull-down stroke. When the pull-down stroke is completed the user again actuates switch 26 to change control valve 12 back to military press configuration, and the user begins another stroke sequence. In each action mode the resistance is maintained at the selected level in the same manner as described above for the action being performed. This unilateral dual action embodiment can be operated as a single action machine for either of the two action modes by leaving control valve 12 in position for the desired action mode. In single action use, switch 26 is used only to select the desired mode, rather than actuated at the end of each power stroke as in dual action mode.

Figure 6:
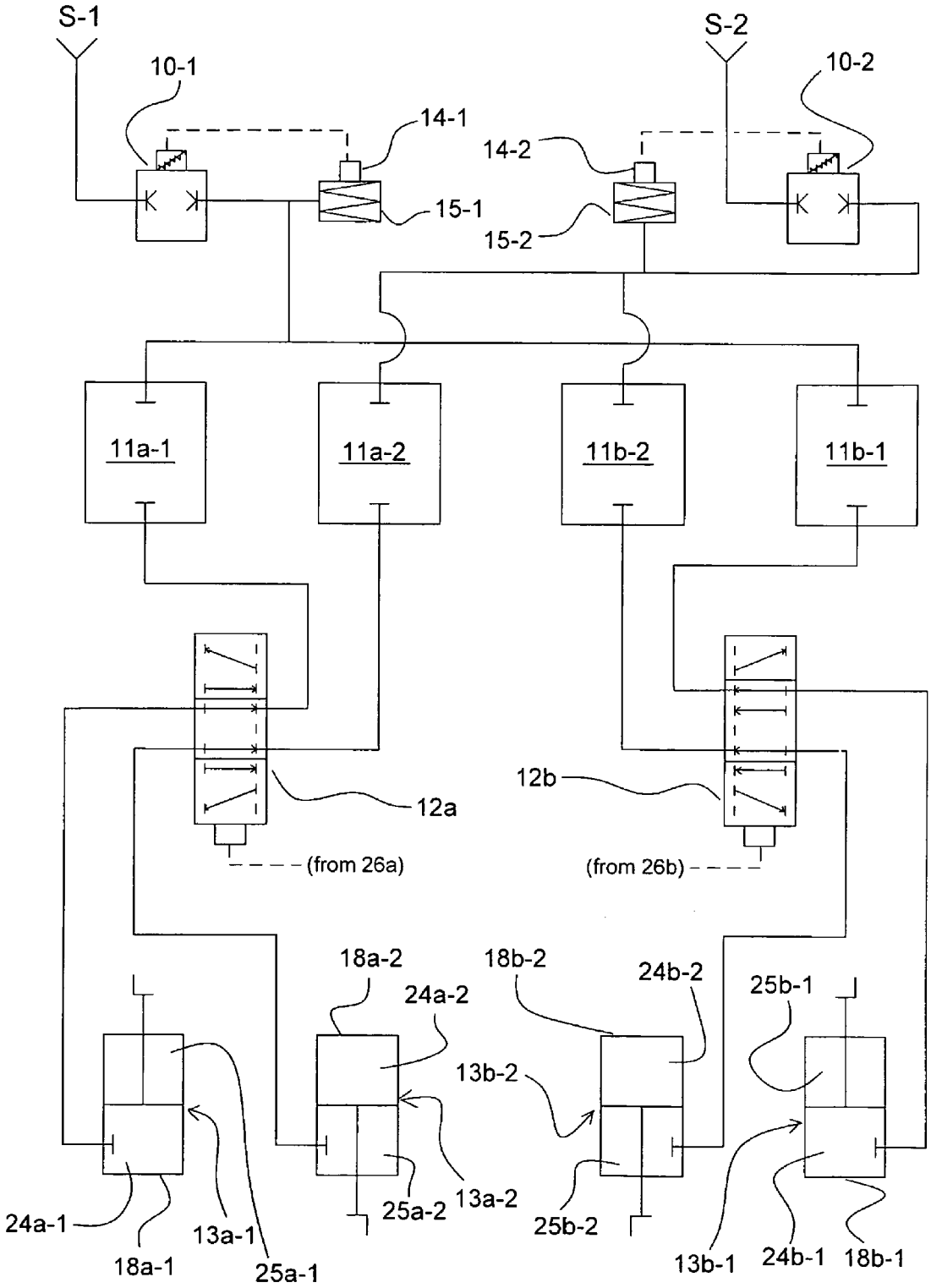
FIG. 6 is a schematic illustration of a bilateral dual action military press and lat pull-down embodiment of the system.

The preferred and most versatile bilateral dual action embodiment is provided by duplicating the unilateral dual action components in mirrored relation on opposite sides of the machine, as schematically illustrated in FIG. 6. This preferred embodiment includes two regulators 10-1 and 10-2, connected to two transducers 15-1 and 15-2 and controlled by potentiometers 14-1 and 14-2, and two independent compressed air sources S-1 and S-2. Regulator 10-1 is connected to both accumulator 11*a*-1 and accumulator 11*b*-1, and feeds compressed air to both accumulators at the same pressure from source S-1. Accumulator 11*a*-1 is connected to space 24 of cylinder 17*a*-1 through control valve 12*a*, and accumulator 11*b*-1 is connected to space 24 of cylinder 17*b*-1 through control valve 12*a*. This sub-system provides and controls resistance for a bilateral military press action mode.

Regulator 10-2 is connected to both accumulator 11*a*-2 and accumulator 11*b*-2, and feeds compressed air to those accumulators from source S-2, at the same pressure, which need not be equal to the pressure provided through regulator 10-1 to accumulators 11*a*-1 and 11*b*-1. Accumulator 11*a*-2 is connected to space 25 of cylinder 17*a*-2 through control valve 12*b*, and accumulator 11*b*-2 is connected to space 25 of cylinder 17*b*-2. This subsystem provides and controls resistance for the lat pull-down action mode. Because there are two control valves 12 in this embodiment, two switches 26 are used. Switch 26*a* actuates control valve 12*a* to switch between modes, and switch 26*b* actuates control valve 12*b* to switch between action modes. As described above in reference to the unilateral dual action embodiment, the bilateral dual action embodiment can be set to operate in military press single action mode, to operate in lat pull-down single action mode, or to operate in press and pull-down dual action mode.

The bilateral dual action embodiment offers to a user the unprecedented ability to exercise in an alternating bilateral mixed mode on the same machine. The bilateral nature of the preferred embodiment allows a user to push upwardly with one arm, in a military press action, while simultaneously pulling downwardly with the opposite arm, in a lat pull-down action. The resistance to upward movements (military press) by each of the user's arms, and the resistance to downward movement (lat pull-down) by each of the two arms can be independently selected, as described above in the context of the unilateral dual action embodiment, and the bilateral division of the preferred embodiment allows the selected resistances to be imposed against each arm whether they are moving up and down at the same time or alternately. The alternating arm movements made possible by the bilateral dual action embodiment of the invention allow a user to exercise in a swimming motion, with one arm pushing upwardly while to other arm is simultaneously pulling downwardly. For clarity, assume that the user is initially pushing up with his or her arm on the a-branch side of the machine, and pulling down with the arm on the b-branch side of the machine. When the pushing arm and the pulling arm reach the limit of that motion, the user actuates both switches 26*a* and 26*b* at the same time. Actuation of switch 26*a* causes control valve 12*a* to switch from military press setting, utilizing cylinder 17*a*-1 to provide resistance, to lat pull-down setting, utilizing cylinder 17*a*-2 to provide resistance on the a-branch side. Similarly, actuation of switch 26*b* causes control valve 12*b* to switch from lat pull-down setting, utilizing cylinder 17*b*-2 for resistance, to military press setting, utilizing cylinder 17*b*-1 for resistance on the b-branch side. When the user then reverses arm movement, the arm on the a-branch side of the equipment is then pulling down against the selected lat pull-down resistance and the arm on the b-branch side is then pushing up against the selected military press resistance. Activation of both switches 26 when both arms have pushed and pulled to the limit of that movement reverses operation again, allowing the user to continue the swimming motion exercise indefinitely.

It is to be understood that in all embodiments of the system of the invention, a user can vary resistance from zero to as high as the pressure of the source compressed air will maintain. At low resistance settings the exercise machine can be used for stretching and warm up exercise, and the resistance then quickly set to higher values through the remainder of the exercise session. Adjustment of the setting of the potentiometer(s) can be performed by a user very easily and quickly during an exercise session without having to move from the machine, so it is very feasible to utilize a variety of resistance settings during an exercise set.

As noted above in the descriptions of operation of exercise equipment utilizing the system of the invention, when the system is in, e.g., military press mode, after a user has pushed the lifting bar(s) to an extended position, the system will provide a downward force as the user lowers the lifting bar(s) to the start position. In lat pull-down mode, when a user has completed a pull-down stroke the system will provide an upward force as the user allows the bar(s) to raise to the start position. That "return force" feature of equipment with the system of the invention provides the unprecedented ability for the equipment to be used in rehabilitation therapy as well as in strength training. For example, when the equipment and system are switched from military press mode to lat pull-down mode, the pressure control components of the system can be set to provide an upward force to raise the lifting bar(s) from the lowered military press start position to the raised lat pull-down start position. If a user grasps the lifting bar(s) with them in the down position (start position for military press) and the machine is changed from military press function to lat pull-down function using switch 26, system pressure will be imposed so as to raise the lifting bar(s) to the lat pull-down start position and pull the user's arm(s) upward. The user may resist that movement with his or her arms, or may allow his or her arms to be raised without the user applying any resistance. If the user then switches from lat pull-down mode to military press mode, the system will provide a downward force on the lifting bar(s) to push the user's arm(s) down as the lifting bar lowers under the set system pressure to return to the military press start position, completing one full pull-push cycle by the machine. In this mode of operation equipment with the system of the invention can be used for "pull up" or "push down" range of motion exercises as well as for a combination of both.

The system of the invention is also susceptible to variation to provide alternative embodiments within the scope of the invention. In the foregoing descriptions, single action piston-cylinders are used, with one or two pistons, depending on the embodiment, to provide resistance to military press action, and one or two, again depending on the embodiment, to provide resistance to lat pull-down action. In an alternative embodiment, double acting piston-cylinder components may be used instead, with the result of reducing the number of piston-cylinder assemblies by half. In a double acting piston-cylinder assembly there are two piston rods extending in opposite directions from the piston through the respective ends of the cylinder, so each double acting assembly can perform the same way as two single acting assemblies. In this alternative embodiment an air line is connected to the cylinder between the piston and the first end, and another air line connected to the cylinder between the piston and the second end of the cylinder. The air line connected at the first end of the cylinder connects to one accumulator through a control valve, and the air line connected at the second end of the cylinder connects to a separate accumulator through the same control valve, so that the pressure at each end of the double acting cylinder can be independently controlled by a user. When a switch is actuated to operate the control valve, in this alternative embodiment the valve switches between the divided cylinder chambers rather than between cylinders as in the embodiments described above.

The system is also subject to the addition of a more sophisticated control system that can be configured to operate the system so as to change resistance settings at various points through the exercise stroke. As a non-limiting example, an alternative control system could set resistance at a first value at the beginning portion of the stroke, a second value at the midpoint of the stroke, and yet another value for the end portion of the stroke. Such a control system would allow a user's exercise regimen to be very finely tuned for maximum benefit. Such a control system could also be used to automatically change resistance settings during a set of repetitions of an exercise as well as or in addition to use to vary resistance within a single stroke. For example, in some training regimens it is desirable for the resistance to increase for the last few repetitions of a set, and the system of the invention is capable of providing that type of variation in a machine's resistance.

In the foregoing descriptions a military press and/or lat pull-down machine configuration is used to illustrate various system configurations for that machine configuration, but it is to be clearly understood that the system can be readily adapted for use with almost any type of exercise machine, and is by no means limited to the single configuration used here for illustration. In adapting the system of the invention for use with equipment designed for other exercises, the primary physical alteration will be the positioning of the pneumatic piston-cylinders 13 so as to provide resistance in the desired direction(s).

The foregoing descriptions of preferred and alternative embodiments of the invention are intended to be illustrative and not limiting of the scope of the invention. Further variations and embodiments may occur to others on the basis of the present description of the invention, all within the scope of the following claims.

The invention claimed is:

1. An apparatus connected to a source of pressurized gas and connected to a piece of exercise equipment, for providing and maintaining a user-selected magnitude of force for the purpose of countering a force imposed by the user against a unilateral lifting bar of the exercise equipment to induce or resist movement of the lifting bar relative to a fixed frame of the equipment throughout the range of movement of the lifting bar actuated by the user, comprising, a pneumatic piston-cylinder assembly for providing such resistance, connected between the lifting bar and the fixed frame of the exercise equipment, said assembly including a cylinder with a hollow interior and with first and second ends, a piston moveably disposed in said interior of said cylinder between said first and second ends, separating said interior of said cylinder into a first space between said first end of said cylinder and said piston and a second space between said piston and said second end of said cylinder, a piston rod with first and second ends, connected at said first end to said piston and extending through said second end of said cylinder with said second end of said piston rod disposed outside said cylinder, and a gas passageway connecting between said interior and the exterior of said cylinder;

a pressure transducer connected in gas flow relationship to said gas passageway of said cylinder so as to allow the communication of gas pressure between said cylinder and said transducer, said transducer including signal generating means for generating an electrical signal in response to and proportional to the gas pressure communicated to said transducer;

an electrically controlled and operated gas flow regulator connected in gas flow relationship to the source of pressurized gas, and connected in an interruptible gas flow relationship to said cylinder so as to allow the flow of gas from the source of pressurized gas to said cylinder through said regulator with said regulator in an open position and block said flow of gas with said regulator in a closed position, said regulator also having a gas outlet for the venting of pressurized gas therefrom with said regulator in a vent position, the position of said regulator set in response to electrical control signals received by said regulator; and an adjustable potentiometer electrically connected to said transducer and electrically connected to said regulator for the purpose of controlling said regulator so as to allow pressurized gas to flow from the source of pressurized gas to said regulator and from said regulator to said cylinder to increase the gas pressure in said cylinder, so as to allow gas to flow from said cylinder to said regulator and be released from said regulator to reduce the gas pressure in said cylinder, and so as to prevent the flow of gas through or from said regulator to maintain the gas pressure in said cylinder, in accordance with the setting of said potentiometer and in response to the electrical signal received therefrom.

2. The apparatus of claim 1, wherein said first end of said cylinder is connected to the lifting bar of the exercise equipment and said second end of said piston rod, extending from said second end of said cylinder, is connected to the fixed frame of the exercise equipment, and wherein said gas passageway between said interior and said exterior of said cylinder is disposed in said cylinder so as to allow the flow of gas to and from said first space of said interior of said cylinder.

3. The apparatus of claim 1, wherein said first end of said cylinder is connected to the fixed frame of the exercise equipment, and said second end of said piston rod, extending from said second end of said cylinder, is connected to the lifting bar of the exercise equipment, and wherein said gas passageway between said interior and said exterior of said cylinder is disposed in said cylinder so as to allow the flow of gas to and from said second space of said interior of said cylinder.

4. The apparatus of claim 1, further comprising an accumulator tank having a hollow interior of greater volume than the volume of said interior of said cylinder, a first gas passageway extending between said interior of said accumulator tank and the exterior thereof and a second gas passageway extending between said interior of said accumulator tank and said exterior thereof, said first gas passageway of said accumulator tank connected to said gas passageway of said cylinder so as to allow the flow of gas and the communication of gas pressure between said cylinder and said accumulator tank, and said second gas passageway of said accumulator tank connected to said gas flow regulator in gas flow relationship therewith, and connected to said transducer in gas pressure communication therewith, said communication of gas pressure between said cylinder and said transducer being through said accumulator tank.

5. The apparatus of claim 2, wherein the apparatus is connected to a second source of pressurized gas in addition to the first source of pressurized gas, and wherein said pneumatic piston-cylinder assembly is a first pneumatic piston-cylinder assembly, said pressure transducer is a first pressure transducer, said gas flow regulator is a first gas flow regulator, and said adjustable potentiometer is a first adjustable potentiometer, the apparatus further comprising, a second pneumatic piston-cylinder assembly for providing resistance against movement of the lifting bar in a second direction, connected between the lifting bar and the fixed frame of the exercise equipment, said second assembly including a second cylinder with a hollow interior and with first and second ends, connected at said first end of said cylinder to the fixed frame of the exercise equipment, a piston moveably disposed in said interior of said second cylinder between said first and second ends, separating said interior of said second cylinder into a first space between said first end of said second cylinder and said piston and a second space between said piston and said second end of said second cylinder, a piston rod with first and second ends, connected at said first end to said piston and extending through said second end of said second cylinder with said second end of said piston rod connected to the lifting bar of the exercise equipment, and a gas passageway connecting between said interior and the exterior of said second space of said cylinder;

a second pressure transducer connected in gas flow relationship to said gas passageway of said second cylinder so as to allow the communication of gas pressure between said second cylinder and said second transducer, said second transducer including signal generating means for generating an electrical signal in response to and proportional to the gas pressure in said second cylinder communicated to said second transducer;

a second electrically controlled and operated gas flow regulator connected in gas flow relationship to the second source of pressurized gas, and connected in an interruptible gas flow relationship to said second cylinder so as to allow the flow of gas from the second source of pressurized gas to said second cylinder through said second regulator with said second regulator in an open position and block said flow of gas with said second regulator in a closed position, said second regulator also having a gas outlet for the venting of pressurized gas therefrom with said second regulator in a vent position, the position of said second regulator set independently of said first regulator, in response to electrical control signals received by said second regulator;

a second adjustable potentiometer electrically connected to said second pressure transducer and electrically connected to said second regulator for the purpose of controlling said second regulator so as to allow pressurized gas to flow from the second source of pressurized gas to said second regulator and from said second regulator to said second cylinder to increase the gas pressure in said second cylinder, so as to allow gas to flow from said second cylinder to said second regulator and be released from said second regulator to reduce the gas pressure in said second cylinder, and so as to prevent the flow of gas through or from said second regulator to maintain the gas pressure in said second cylinder, in accordance with the setting of said second potentiometer and in response to the electrical signal received therefrom; and a flow control valve having a first gas flow passageway for establishing a first gas flow connection between the first source of pressurized gas and said first cylinder, and a second gas flow passageway for establishing a second gas flow connection between said second source of pressurized gas and said second cylinder, said flow control valve being operable to alternate between a first position in which said first gas flow connection is established and said second gas flow connection is broken, and a second position in which said second gas flow connection is established and said first gas flow connection is broken.

6. The apparatus of claim 5, wherein the operation of said flow control valve is electrically actuated, and the apparatus further comprises an electrical switch operable by the user of the exercise equipment to actuate the operation of said control valve to alternate between said first position and said second position.

7. The apparatus of claim 5, further comprising, a first accumulator tank having a hollow interior of greater volume than the volume of said interior of said first cylinder, a first gas passageway extending between said interior of said first accumulator tank and the exterior thereof and a second gas passageway extending between said interior of said first accumulator tank and said exterior thereof, said first gas passageway of said first accumulator tank connected to said gas passageway of said first cylinder so as to allow the flow of gas and the communication of gas pressure between said first cylinder and said first accumulator tank, and said second gas passageway of said first accumulator tank connected to said first gas flow regulator in gas flow relationship therewith, and connected to said first transducer in gas pressure communication therewith, said communication of gas pressure between said first cylinder and said first transducer being through said first accumulator tank; and a second accumulator tank having a hollow interior of greater volume than the volume of said interior of said second cylinder, a first gas passageway extending between said interior of said second accumulator tank and the exterior thereof and a second gas passageway extending between said interior of said second accumulator tank and said exterior thereof, said first gas passageway of said second accumulator tank connected to said gas passageway of said second cylinder so as to allow the flow of gas and the communication of gas pressure between said second cylinder and said second accumulator tank, and said second gas passageway of said second accumulator tank connected to said second gas flow regulator in gas flow relationship therewith, and connected to said second transducer in gas pressure communication therewith, said communication of gas pressure between said second cylinder and said second transducer being through said first accumulator tank.

8. An apparatus connected to a source of pressurized gas and connected to a piece of exercise equipment, for providing and maintaining the magnitude of user-selected force applied independently to each of a bilateral set of first and second lifting bars of the exercise equipment to resist force imposed independently by the user against each of the lifting bars to induce or resist movement of the lifting bars relative to a fixed frame of the equipment throughout the range of movement of each of the lifting bars from a first position to a second position and from the second position to return to the first position, comprising, a first pneumatic piston-cylinder assembly for providing resistance to movement of the first lifting bar, connected between the first lifting bar and the fixed frame of the exercise equipment, said first piston-cylinder assembly including a cylinder with a hollow interior and with first and second ends, a piston moveably disposed in said interior of said cylinder between said first and second ends, separating said interior of said cylinder into a first space between said first end of said cylinder and said piston and a second space between said piston and said second end of said cylinder, a piston rod with first and second ends, connected at said first end to said piston and extending through said second end of said cylinder with said second end of said piston rod disposed outside said cylinder, and a gas passageway connecting between said interior and the exterior of said cylinder;

a second pneumatic piston-cylinder assembly for providing resistance to movement of the second lifting bar, connected between the second lifting bar and the fixed frame of the exercise equipment, said second piston-cylinder assembly including a cylinder with a hollow interior and with first and second ends, a piston moveably disposed in said interior of said cylinder between said first and second ends, separating said interior of said cylinder into a first space between said first end of said cylinder and said piston and a second space between said piston and said second end of said cylinder, a piston rod with first and second ends, connected at said first end to said piston and extending through said second end of said cylinder with said second end of said piston rod disposed outside said cylinder, and a gas passageway connecting between said interior and the exterior of said cylinder;

a pressure transducer connected in gas flow relationship to said cylinders of both said first and second piston-cylinder assemblies so as to allow the communication of gas pressure between said cylinders and said transducer, said transducer including signal generating means for generating an electrical signal in response to and proportional to the gas pressure communicated to said transducer;

an electrically controlled and operated gas flow regulator connected in gas flow relationship to the source of pressurized gas, and connected in an interruptible gas flow relationship to said cylinders of said first and second piston-cylinder assemblies so as to allow the flow of gas from the source of pressurized gas to both said cylinders through said regulator with said regulator in an open position and to block said flow of gas with said regulator in a closed position, said regulator also having a gas outlet for the venting of pressurized gas therefrom with said regulator in a vent position, the position of said regulator set in response to electrical control signals received by said regulator; and an adjustable potentiometer electrically connected to said transducer and electrically connected to said regulator for the purpose of controlling said regulator so as to allow pressurized gas to flow from the source of pressurized gas to said regulator and from said regulator to both said cylinders to increase the gas pressure in said cylinders, so as to allow gas to flow from said cylinders to said regulator and be released from said regulator to reduce the gas pressure in said cylinders, and so as to prevent the flow of gas through or from said regulator to maintain the gas pressure in said cylinders, in accordance with the setting of said potentiometer and in response to the electrical signal received therefrom.

9. The apparatus of claim 8, wherein said first end of said cylinder of said first piston-cylinder assembly is connected to the first lifting bar of the exercise equipment and said second end of said piston rod of said first piston-cylinder assembly, extending from said second end of said cylinder, is connected to the fixed frame of the exercise equipment, wherein said first end of said cylinder of said second piston-cylinder assembly is connected to the second lifting bar of the exercise equipment and said second end of said piston rod of said second piston-cylinder assembly is connected to the fixed frame of the exercise equipment, and wherein said gas passageway between said interior and said exterior of each of said cylinders is disposed in said cylinders so as to allow the flow of gas to and from said first space of said interior of each of said cylinders.

10. The apparatus of claim 8, wherein said first end of said cylinder of said first piston-cylinder assembly is connected to the fixed frame of the exercise equipment and said second end of said piston rod, extending from said second end of said cylinder, is connected to the first lifting bar of the exercise equipment, wherein said first end of said cylinder of said second piston-cylinder assembly is connected to the fixed frame of the exercise equipment and said second end of said piston rod of said second piston-cylinder assembly is connected to the second lifting bar, and wherein said gas passageway between said interior and said exterior of said cylinders is disposed in said cylinders so as to allow the flow of gas to and from said second space of said interior of each of said cylinders.

11. The apparatus of claim 8, further comprising, a first accumulator tank having a hollow interior of greater volume than the volume of said interior of said first cylinder, a first gas passageway extending between said interior of said first accumulator tank and the exterior thereof and a second gas passageway extending between said interior of said first accumulator tank and said exterior thereof, said first gas passageway of said first accumulator tank connected to said gas passageway of said cylinder of said first piston-cylinder assembly so as to allow the flow of gas and the communication of gas pressure between said cylinder of said first piston-cylinder assembly and said first accumulator tank, and said second gas passageway of said first accumulator tank connected to said gas flow regulator in gas flow relationship therewith, and connected to said transducer in gas pressure communication therewith, said communication of gas pressure between said cylinder of said first piston-cylinder assembly and said transducer being through said first accumulator tank; and a second accumulator tank having a hollow interior of greater volume than the volume of said interior of said cylinder of said second piston-cylinder assembly, a first gas passageway extending between said interior of said second accumulator tank and the exterior thereof and a second gas passageway extending between said interior of said second accumulator tank and said exterior thereof, said first gas passageway of said second accumulator tank connected to said gas passageway of said cylinder of said second piston-cylinder assembly so as to allow the flow of gas and the communication of gas pressure between said cylinder of said second piston-cylinder assembly and said second accumulator tank, and said second gas passageway of said second accumulator tank connected to said gas flow regulator in gas flow relationship therewith, and connected to said transducer in gas pressure communication therewith, said communication of gas pressure between said cylinder of said second piston-cylinder assembly and said transducer being through said second accumulator tank.

12. An apparatus connected to a first source of pressurized gas and to a separate, second source of pressurized gas, and connected to a piece of exercise equipment, for providing and maintaining the magnitude of user-selected force applied independently to each of a bilateral set of independently movable first and second lifting bars of the exercise equipment to resist forces imposed by the user of the equipment independently against each of the lifting bars to induce or resist movement of the respective lifting bar relative to a fixed frame of the equipment throughout the range of movement of that lifting bar actuated by the user, comprising, a first pair of pneumatic piston-cylinder assemblies and a second pair of piston-cylinder assemblies, for providing resistance to and inducing movement of the lifting bars of the exercise equipment, the first piston cylinder assembly of said first pair and the second piston-cylinder assembly of said second pair connected between the first lifting bar and the fixed frame of the exercise equipment, the second piston-cylinder assembly of said first pair and the first piston-cylinder of said second pair connected between the second lifting bar and the fixed frame of the exercise equipment, each of said piston-cylinder assemblies including a cylinder with a hollow interior and with first and second ends, a piston moveably disposed in said interior of said cylinder between said first and second ends, separating said interior of said cylinder into a first space between said first end of said cylinder and said piston and a second space between said piston and said second end of said cylinder, a piston rod with first and second ends, connected at said first end to said piston and extending through said second end of said cylinder with said second end of said piston rod disposed outside said cylinder, said cylinder of said first piston-cylinder assembly of said first pair of piston-cylinder assemblies and said cylinder of said first piston-cylinder assembly of said second pair of piston-cylinder assemblies each having a gas passageway connecting between said interior of said first space of said cylinder and the exterior of said cylinder, said gas passageways of said cylinders of said first piston-cylinder assemblies of said first and second pair of piston-cylinder assemblies connected in gas flow communication to the first source of pressurized gas, and said cylinder of said second piston-cylinder assembly of said first pair of piston-cylinder assemblies and said cylinder of said second piston-cylinder assembly of said second pair of piston-cylinder assemblies each having a gas passageway connecting between said interior of said second space of said cylinder and the exterior of said cylinder, said gas passageways of said cylinders of said second piston-cylinder assemblies of said first and second pair of piston-cylinder assemblies connected in gas flow communication to the second source of pressurized gas;

a first flow control valve and a second flow control valve, each having a first gas flow passageway for establishing a first gas flow path through said valve and a second gas flow passageway for establishing a second gas flow path through said valve, each said flow control valve being operable to alternate between a first position in which said first gas flow path is established and said second gas flow path is broken, and a second position in which said second gas flow path is established and said first gas flow path is broken, said first flow path of said first control valve connecting between said first piston-cylinder assembly of said first pair of piston-cylinder assemblies and the first source of pressurized gas with said first flow path established, and said second flow path of said first control valve connecting between said second piston-cylinder assembly of said second pair of piston-cylinder assemblies and the second source of pressurized gas with said second flow path established, said first flow path of said second control valve connecting between said second piston-cylinder assembly of said first pair of piston-cylinder assemblies and the first source of pressurized gas with said first flow path established, and said second flow path of said second control valve connecting between said first piston-cylinder assembly and the second source of pressurized gas with said second flow path established;

a first pressure transducer and a second pressure transducer, each of said transducers including pressure sensing means and signal generating means for generating a data signal in response to and proportional to the sensed pressure, said first pressure transducer connected in gas pressure communication between the first source of pressurized gas and said first piston-cylinder assembly of said first pair of piston-cylinder assemblies through said first flow path of said first flow control valve and between the first source of pressurized gas and said first piston-cylinder assembly of said second pair of piston-cylinder assemblies through said first flow path of said second control valve, and said second pressure transducer connected in gas pressure communication between the second source of pressurized gas and said second piston-cylinder assembly of said first pair of piston-cylinder assemblies through said second flow path of said first flow control valve and between the second source of pressurized gas and said second piston-cylinder assembly of said second pair of piston-cylinder assemblies through said second flow path of said second flow control valve;

a first adjustable potentiometer and a second adjustable potentiometer, to receive data signals from said first pressure transducer and from said second pressure transducer, respectively, compare the data received to a preselected value and generate electrical signals dependent upon such comparison, said first potentiometer electrically connected to said first pressure transducer to receive data signals therefrom, and said second potentiometer electrically connected to said second pressure transducer to receive data signals therefrom; and a first electrically controlled and operated gas flow regulator and a second electrically controlled and operated gas flow regulator, each of said gas flow regulators operable for opening and closing a gas flow path through said regulator and for releasing gas external to said flow path in response to control signals received by said regulator, said first regulator connected in gas flow relationship to the first source of pressurized gas and connected to said first piston-cylinder assembly of said first pair of piston-cylinder assemblies through said first flow path of said first flow control valve and to said first piston-cylinder assembly of said second pair of piston-cylinder assemblies through said first flow path of said second flow control valve, said second gas flow regulator connected in gas flow relationship to the second source of pressurized gas and connected to said second piston-cylinder of said first pair of piston-cylinder assemblies through said second flow path of said first flow control valve and to said second piston-cylinder assembly of said second pair of piston-cylinder assemblies through said second flow path of said second control valve, said first gas flow regulator electrically connected to said first potentiometer to receive electrical signals therefrom for controlling operation of said first gas flow regulator and said second gas flow regulator electrically connected to said second potentiometer to receive electrical signals therefrom for controlling operation of said second gas flow regulator.

13. The apparatus of claim 12, wherein the operation of said first and second flow control valves is electrically actuated, and wherein the apparatus further comprises a first electrical switch operable by the user of the exercise equipment to actuate the operation of said first control valve to alternate between said first position and said second position, and a second electrical switch operable by the user of the exercise equipment to actuate the operation of said second control valve to alternate between said first position and said second position.

14. The apparatus of claim 12, further comprising, a first accumulator tank having a hollow interior, connected in gas flow communication and in gas pressure communication through said interior of said first accumulator tank between said first gas flow regulator and said first flow path of said first gas flow control valve;

a second accumulator tank having a hollow interior, connected in gas flow communication and in gas pressure communication through said interior of said second accumulator tank between said first gas flow regulator and said first flow path of said second gas flow control valve;

a third accumulator tank having a hollow interior, connected in gas flow communication and in gas pressure communication through said interior of said third accumulator tank between said second gas flow regulator and said second flow path of said first gas flow control valve; and a fourth accumulator tank having a hollow interior, connected in gas flow communication and in gas pressure communication through said interior of said fourth accumulator tank between said second gas flow regulator and said second flow path of said second gas flow control valve.

15. A method of controlling pneumatic exercise equipment to provide a consistent level of force to resist movement by a user of a movable lifting bar component of the exercise equipment in a first direction from a start position to an end position and to induce movement of the lifting bar in a second direction to return from the end position to the start position against resistance supplied by the user, the exercise equipment having a pneumatic piston-cylinder assembly connected between the lifting bar and a fixed frame of the exercise equipment with the lifting bar pivotally connected to the fixed frame so as to allow movement of the lifting bar relative to the fixed frame, and with the piston-cylinder assembly connected to a source of pressurized gas, comprising the steps of, selecting the gas pressure to be maintained in the interior of the piston-cylinder assembly in order to provide the magnitude of force desired by the user to be imposed upon the lifting bar by the piston-cylinder assembly;

admitting gas from the source of pressurized gas to the interior of the piston-cylinder assembly;

sensing the gas pressure within the piston-cylinder assembly;

ceasing to admit gas to the interior of the piston-cylinder assembly when the sensed gas pressure within the piston-cylinder assembly equals the selected gas pressure;

sensing the increase in gas pressure within the piston-cylinder assembly initiated by initiation of movement of the lifting bar by the user in the first direction from the start position;

venting pressurized gas in response to the sensed increase in gas pressure throughout the movement of the lifting bar in the first direction so as to maintain the pressure within the piston-cylinder assembly equal to the selected gas pressure, regardless of the speed at which the user moves the lifting bar in the first direction;

sensing the decrease in gas pressure within the piston-cylinder assembly initiated by initiation of movement of the lifting bar in the second direction from the end position toward the start position against resistance provided by the user; and admitting pressurized gas from the source of pressurized gas to the interior of the piston-cylinder assembly throughout the movement of the lifting bar in the second direction to return to the start position so as to maintain the pressure within the piston-cylinder assembly equal to the selected gas pressure, regardless of the speed of movement of the lifting bar in the second direction.

16. A method of controlling pneumatic exercise equipment to provide a consistent level of force to resist movement by a user of a movable lifting bar component of the exercise equipment in a first direction from a start position to a stop position for a first exercise mode, and, for a second exercise mode alternating with the first exercise mode, to resist movement of the lifting bar by the user in a second direction from the stop position of the first exercise mode to return to the start position for the first exercise mode, the exercise equipment having a first pneumatic piston-cylinder assembly connected between the lifting bar and a fixed frame of the exercise equipment with the first piston-cylinder assembly connected to a first source of pressurized gas, a second pneumatic piston-cylinder assembly connected between the fixed frame and the lifting bar with the second piston-cylinder assembly connected to a second source of pressurized gas, and a gas flow control valve operable by the user to alternate between a first position connecting the first source of pressurized gas to the first piston-cylinder assembly without connecting the second source of pressurized gas to the second piston-cylinder assembly, and a second position connecting the second source of pressurized gas to the second piston-cylinder assembly without connecting the first source of pressurized gas to the first piston-cylinder assembly, comprising the steps of, selecting a first gas pressure to be maintained in the interior of the first piston-cylinder assembly to provide the resistance desired by the user against and during movement of the lifting bar by the user in the first direction;

selecting a second gas pressure to be maintained in the interior of the second piston-cylinder assembly to provide the resistance desired by the user against and during movement of the lifting bar by the user in the second direction;

operating the gas flow control valve as needed to place the gas flow control valve in the first position, selecting the first exercise mode;

admitting gas from the first source of pressurized gas to the interior of the first piston-cylinder assembly with the flow control valve in the first position;

sensing the gas pressure within the first piston-cylinder assembly;

ceasing to admit gas to the interior of the first piston-cylinder assembly when the sensed gas pressure within the first piston-cylinder assembly equals the selected first gas pressure;

sensing an increase in gas pressure within the first piston-cylinder assembly initiated by initiation of movement of the lifting bar by the user in the first direction from the start position of the first exercise mode;

venting pressurized gas from the first piston-cylinder assembly in response to the initiation of an increase in gas pressure so as to maintain the selected first gas pressure within the first piston-cylinder assembly to provide a consistent resistance throughout movement of the lifting bar by the user between the start position and the stop position for the first exercise mode independent of the speed of movement of the lifting bar by the user, completing a first repetition of the first exercise mode;

operating the gas flow control valve to switch from the first position to the second position, switching from the first exercise mode to the second exercise mode;

admitting gas from the second source of pressurized gas to the interior of the second piston-cylinder assembly with the flow control valve in the second position;

sensing the gas pressure within the second piston-cylinder assembly;

ceasing to admit gas to the interior of the second piston-cylinder assembly when the sensed gas pressure within the second piston-cylinder assembly equals the selected second gas pressure;

sensing an increase in gas pressure within the second piston-cylinder assembly initiated by initiation of movement of the lifting bar by the user in the second direction from the stop position of the first exercise mode; and venting pressurized gas from the second piston-cylinder assembly in response to the initiation of an increase in gas pressure so as to maintain the selected second gas pressure within the second piston-cylinder assembly and provide a consistent resistance throughout movement of the lifting bar by the user in the second direction independent of the speed of movement of the lifting bar by the user, completing a first repetition of the second exercise mode and returning the lifting bar to the start position for the first exercise mode.

* * * * *